United States Patent [19]

Franzosi

[11] 4,205,599

[45] Jun. 3, 1980

[54] APPARATUS FOR MANUFACTURING GASIFIED LIQUIDS

[75] Inventor: Mario C. Franzosi, Cordoba, Argentina

[73] Assignees: Jose Francisco Franzosi; Alberto Lorenzo Franzosi, both of Cordoba, Argentina

[21] Appl. No.: 847,859

[22] Filed: Nov. 2, 1977

[30] Foreign Application Priority Data

Nov. 5, 1976 [AR] Argentina ..... 265361
Aug. 22, 1977 [AR] Argentina ..... 268889

[51] Int. Cl.[2] ..... B01F 3/04

[52] U.S. Cl. ..... 99/323.1; 261/18 B; 261/133

[58] Field of Search ..... 99/323.1, 275, 323.2; 261/133, 18 R, 18 B, 20, DIG. 7; 366/101

[56] References Cited

U.S. PATENT DOCUMENTS

| | | | |
|---|---|---|---|
| 3,090,293 | 5/1963 | Plock | 99/323.1 |
| 3,393,631 | 7/1968 | Harrison | 99/323.2 |
| 3,741,552 | 6/1973 | Witt | 261/DIG. 7 |
| 3,960,066 | 6/1976 | Knorr | 99/323.2 |
| 3,993,219 | 11/1976 | Franzosi | 222/56 |

*Primary Examiner*—Robert W. Jenkins
*Attorney, Agent, or Firm*—Fleit & Jacobson

[57] ABSTRACT

An apparatus for manufacturing gasified liquids. A Venturi-type device is provided at a water inlet of a deaerating vessel of the apparatus to deaerate the water. A mixing and metering stage connected to the deaerating vessel is controlled by a regulating valve. A precarbonating device is positioned between the valve and a final carbonating vessel to intimately contact and mix liquid and gaseous components. A check valve is provided at the input of the final vessel for additional mixing. Also, a Venturi-type device at the input provides saturation of the mixture with the gas. The apparatus also includes an easily cleaned distributing tray and mechanism for cleaning the tray. A device similar to the precarbonating valve can be used to intimately contact a gas and liquid.

17 Claims, 19 Drawing Figures

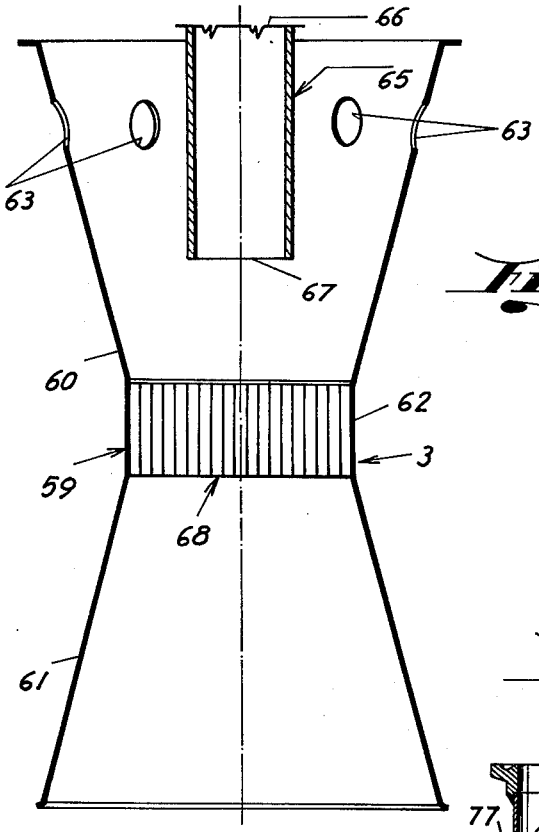
Fig. 2
Fig. 3
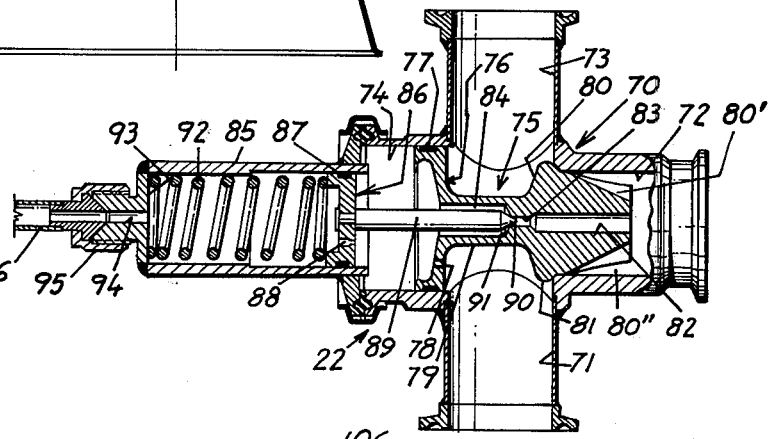
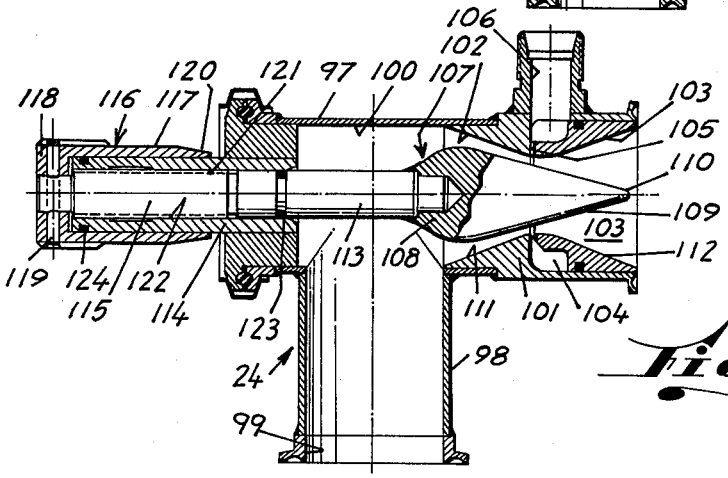
Fig. 4

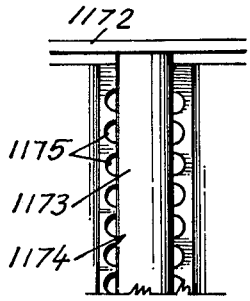
Fig. 10
Fig. 11
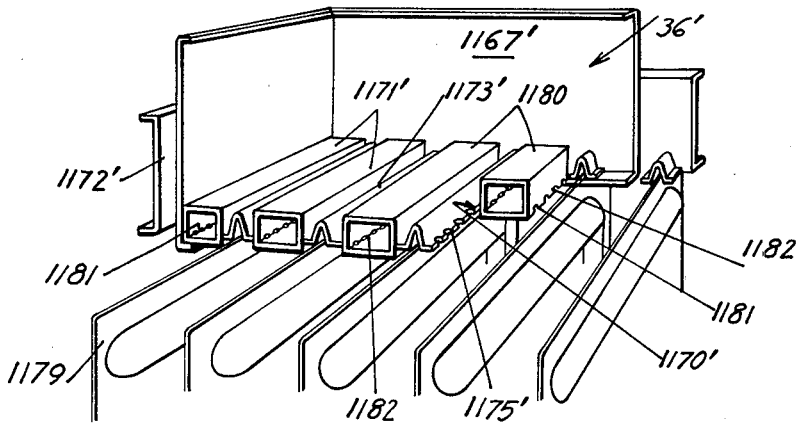
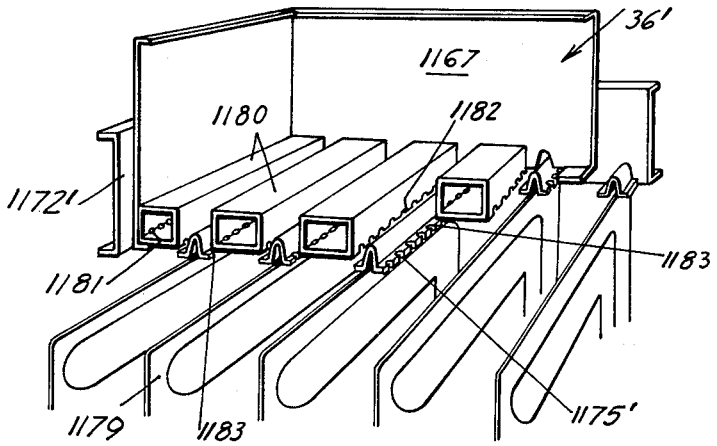
Fig. 12

APPARATUS FOR MANUFACTURING GASIFIED LIQUIDS

FIELD OF THE INVENTION

The present invention relates to an apparatus for manufacturing gasified liquids in general, and more particularly soft beverages, which comprises several improvements provided in critical points of the process carried out by the apparatus.

BACKGROUND OF THE INVENTION

Various types of apparatus are known which are designed for this kind of operation. Certain types have obtained greater acceptance than others. This invention provides improvements in some critical parts of an apparatus of one of said types which has been known since long ago. This type of apparatus comprises, in general, a water deaerating stage, a deaerated water and syrup mixing stage capable of accurately metering the syrup and water components of the mixture, and precarbonating stage in which a gas such as carbon dioxide is introduced in a current of said water-syrup mixture, and a final carbonating stage in which said mixture is saturated with the same or another gas, after which the mixture is refrigerated, settled and finally discharged from this stage as the final product.

The same applicant has already introduced important improvements in apparatus of this type. One such improvement comprises a special design of the mixing and metering stage which has been described, illustrated and claimed in U.S. Pat. No. 3,993,219 granted Nov. 23, 1976, to the same applicant of this invention.

The present invention provides still other improvements in this kind of apparatus which allows an even more considerable increase in the efficiency thereof; such other improvements have been described, illustrated and claimed in Argentine patent applications Ser. No. 265,361 filed on Nov. 5, 1976, and Ser. No. 268,889 filed on Aug. 22, 1977, by the same applicant of this invention.

The apparatus of the present invention comprises modifications which have in general the primary aim of obtaining the maximum possible division of the gas, such as carbon dioxide, into bubbles as small as possible so as to individually offer a maximum area of contact thereof with the liquid into which they must be diffused, and remain diffused. This allows the obtaining of a very uniform end product which has a high degree of homogeneity, and which has incorporated the maximum possible volume of gas for each definite type of end product.

This result is obtained intentionally creating turbulences and collisions between meeting streams at suitable different points along the path of the liquid from the precarbonating stage until its introduction into the final carbonating vessel, and specially by means of the novel and characteristic design of the precarbonating device, which allows the introduction of a gas such as carbon dioxide in the stream of syrup-water mixture, maintaining a constant ratio between the volume of the syrup-water mixture and the volume of the gas, and allowing also a considerably better intimate contact between the gas and the syrup-water mixture.

At other points along said path of the liquid streams there are intentionally produced additional turbulences and/or collisions between meeting streams (as the case may be). At one of such points a check valve of novel design is arranged, just before the entrance of the mixture to the final carbonating vessel, this valve acting not only as a check valve, but performing also the additional and simultaneous function of still more improving the mixing action and intimate contact between the liquid stream and the gas.

In the final carbonating vessel is also provided a device, based on the Venturi principle, which gives rise to a still better intimate contact between the syrup-water-gas mixture coming from the precarbonating stage, thus promoting a complete saturation of said mixture with additional gas which is introduced also in the final carbonating vessel.

These two features also form important aspects of the present invention.

A modulating valve of new design, controlling the rate-of-flow of the stream of liquid fed to the precarbonating stage according to the level of the liquid in the corresponding tank of the metering and mixing device of the apparatus, is provided between the output of the mixing and metering stage and the input to the precarbonating stage.

Another improvement provided by this invention is a deaerating device, based on the Venturi principle, which is arranged at the input of the deaerating vessel, which divides the entering water stream in many small jets so as to allow the vacuum pump to extract from the water any trace of air which could be present in it, thus improving to a high degree the efficiency of this stage, the function of which is to extract to the highest degree possible the air contained in the water.

Another new feature provided by the present invention is a new construction of the distributing tray of the final carbonating vessel which allows a thorough, quick and automatic cleaning and sanitation without it being necessary to disassemble the tray and its supporting structure.

Another improvement provided in the apparatus is an automatic washing arrangement associated with the tray distributing the product introduced into the final carbonating vessel.

OBJECTS OF THE INVENTION

Thus, it is a general object of this invention to provide an apparatus for manufacturing gasified liquids and the like, particularly soft drinks.

Another object of this invention is to provide an apparatus of the kind mentioned which has a considerably improved operating efficiency.

A further object of this invention is the provision of an apparatus of the kind mentioned which is capable of providing a final product which has a specially uniform quality.

Another object of this invention is to provide an apparatus of the kind mentioned which is capable of allowing at any moment the obtaining of the particular characteristics of any of a plurality of final products of different types.

More specifically, it is an object of this invention to provide an apparatus of the kind mentioned which allows the obtention of a better deaerating of the water used in the production of the syrup-water mixture.

Another specific object of this invention is the provision of a modulating valve of new design which is capable of controlling the rate-of-flow of the stream fed to the precarbonating stage in accordance with the level of the liquid in the corresponding tank of the metering and mixing device of the apparatus.

A fundamental object of this invention is the provision of an apparatus of the kind mentioned which allows a more definite subdivision of the gas (such as carbon dioxide) injected into the mixture, so as to obtain a greater contact area between the small bubbles of the gas and the syrup-water liquid mixture, thus providing a more intimate mixing of both components.

Another specific object of this invention is to provide, at the inlet of the final carbonating vessel, a check valve of novel design which simultaneously allows the obtaining of a still more intimate contact between both liquid and gaseous components.

A still further specific object of this invention is to provide additional means, within the final carbonating vessel, based on the Venturi principle which allow a maximum and final increase of the intimate contact and mixing between both liquid and gaseous components.

Another specific object of this invention is to provide an apparatus of the kind mentioned which incorporates a distributing tray of new design in the final carbonating vessel, allowing a better and more thorough washing and sanitation thereof without the neccesity of disassembling it.

A further specific object of this invention is to provide a rotating jet washing arrangement which allows a still more thorough washing and sanitation of said distributing tray.

SUMMARY OF THE INVENTION

Certain of these objects are attained providing an apparatus for manufacturing gasified liquids, of the type having a water deaerating vessel, a metering and mixing device having a syrup-water mixture tank, a precarbonating device and a final carbonating vessel, wherein the precarbonating device comprises: a Venturi chamber, the input section of which being connectable to an output of said syrup-water mixture tank and the output section being connectable to an input of the final carbonating vessel; a flow control member arranged within said chamber and shaped so as to greatly promote turbulence in the flow of the liquid through said chamber, and gas input means connectable to a source of pressurized gas and communicating with said chamber.

Certain other objects are attained providing an apparatus for manufacturing gasified liquids, of the type having a final carbonating vessel, wherein in the upper portion of said final carbonating vessel at least one liquid distributing tray is arranged, the trays constituting a partition separating an upper compartment from a lower compartment within said vessel, each tray comprising two relatively movable members, one of which is provided with at least one comparatively large opening, said members being relatively movable from a first position in which said comparatively large openings are entirely uncovered allowing an unrestricted flow of liquid therethrough to a second position in which said comparatively large openings of said one member are partially covered by the second member so as to leave uncovered only a restricted area of said relatively large openings and thus allowing only a restricted flow of liquid therethrough, the relative movement of said members from one position to the other and vice versa being controllable by means of control means externally actuatable.

BRIEF DESCRIPTION OF THE DRAWINGS

In order to facilitate the comprehension of the present invention, specific embodiments thereof, which at present are considered as preferred embodiments, will be described with reference to the accompanying drawings, in which:

FIG. 2 is an elevation cross-section of the Venturi type device used with the deaerating vessel and the final carbonating vessel;

FIG. 3 is a longitudinal cross-section of the automatically controlled rate-of-flow controlling valve provided between the mixing-metering apparatus and the precarbonating device;

FIG. 4 is a longitudinal cross-section of the precarbonating device controlling the liquid-gas ratio of the mixture;

FIGS. 8 to 18 are schematic representations of various embodiments of new constructions of the distributing tray usable in the final carbonating vessel.

In the several figures, the same reference numerals identify equal or similar parts.

DESCRIPTION OF PREFERRED EMBODIMENTS OF THE INVENTION

Figure 1:
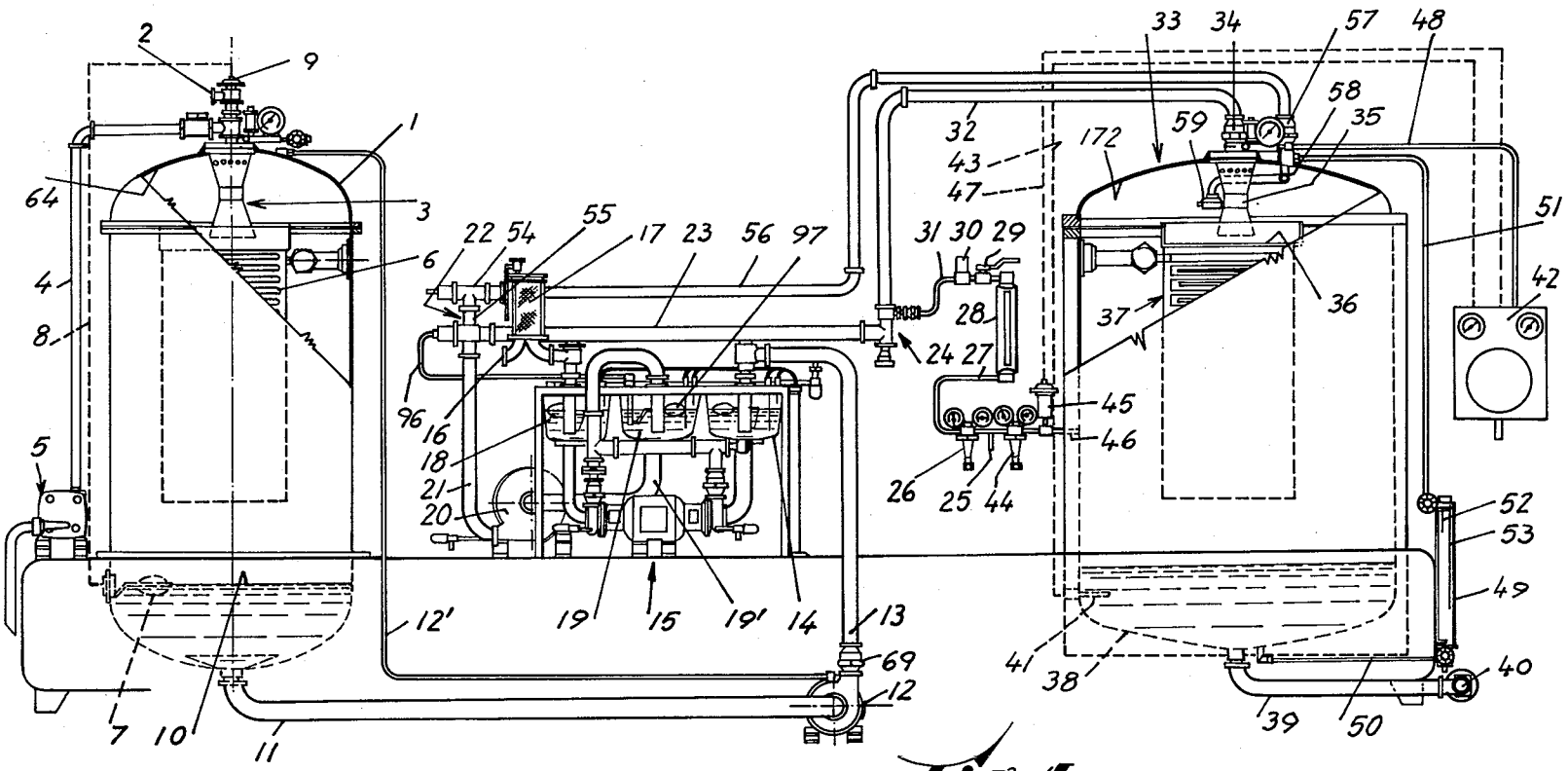
FIG. 1 is a schematic representation of the apparatus incorporating the present invention.

Referring now to FIG. 1 of the drawings, there is illustrated schematically the apparatus of this invention which comprises a deaerating vessel 1 into which, through a water input 2, there is introduced a stream of water (supplied by a suitable source), the stream passing through a Venturi type device 3 which divides it into a plurality of very thin jets, thus allowing the water to give up more thoroughly the air mixed therewith. The air is sucked from the vessel through conduit 4 by means of a vacuum pump 5. The water introduced into vessel 1, after passing through the Venturi 3, falls onto a cooling system 6 operating with ammonia or other suitable refrigerating gas. The water level in the bottom of vessel 1 is controlled by a float 7 which controls (by conventional means represented by the dashed line 8) a valve 9, so that when the water level 10 rises in the bottom of vessel 1 and thus the float 7 also rises, valve 9 will reduce the rate of inflow of the water and vice versa, so maintaining substantially constant the water level 10. The deaerated and cooled water is withdrawn from the bottom of vessel 1 through conduit 11 by means of a water pump 12 and thereafter flows through a conduit 13 to the water tank 14 of the mixing and metering apparatus indicated in general at 15. A priming conduit 12' is provided, extending from the output of water pump 12 to the top of the deaerating vessel 1. The mixing and metering apparatus 15 will be described only to the degree necessary to be able to explain the operation of the other components of the equipment, since said mixing and metering apparatus does not form part of this invention, being the subject matter of the above mentioned U.S. Pat. No. 3,993,219 granted to the same applicant as of this invention.

Syrup is introduced through the syrup input 16, passing through a filter 17 and being introduced into the syrup tank 18 of the mixing and metering apparatus.

Through pumping and metering means, there is simultaneously withdrawn water from the water tank 14 and syrup from the syrup tank 18, both being introduced at the same time into the water-syrup mixture tank 19. The mixture is withdrawn from tank 19 by means of a centrifugal pump 20 the output of which is connected, by means of a conduit 21, to a valve capable of controlling the rate-of-flow of the syrup-water mixture in accordance to the level of said mixture in tank 19. Through conduit 23 the mixture is carried from valve 22 to a precarbonating device 24, in which are simultaneously introduced the syrup-water mixture and a gas, such as carbon dioxide gas. In this device, based on the Venturi principle, the liquid and gaseous components are very finely divided, so that very small bubbles of gas are intimately mixed with the liquid, there being thus offered a considerable contact area between both components, and the mixing action is further improved by the turbulence intentionally created at the output section of the Venturi. A gas, such as carbon dioxide, is supplied from a suitable source to the gas input 25 and, through a suitable manually adjustable valve 26, a conduit 27, a gas rate-of-flow meter 28 of the "rotameter" type, a manually controllable restriction 29, a solenoid valve 30 and a conduit 31, is introduced into the precarbonating device 24. The solenoid valve 30 has an energization winding which under normal operating conditions is energizable in response to the starting of the pumping system of the mixing and metering apparatus, the operation of which will open the valve 30 and thus allow the feeding of the gas to the pecarbonating device 24. When the operation of the mixing and metering apparatus 15 is stopped, valve 30 will automatically close the flow of gas toward the precarbonating device 24. But if the operation of the mixing and metering apparatus 15 is stopped, valve 30 will close preventing the supply of further gas to the precarbonating device 24. The electrical connections of the solenoid valve 30 may be switched so as to maintain closed valve 30 during rinsing and washing operations.

From the precarbonating device 24, the liquid-gas mixture is supplied through a conduit 32 to the final carbonating vessel indicated in 33, a check valve 34 and a Venturi type device capable of further improving the mixing of the gas with the liquid. From the Venturi type device 35 the mixture falls onto a distributing tray 36 from which it flows over cooling plates 37 cooled by ammonia or other suitable refrigerating gas. The liquid, now completely saturated with gas, drains from the cooling plates 37 onto the bottom 38 of the final carbonating vessel from where it is withdrawn through output conduit 39 which is selectively connectable to a filling equipment or to a drainage (this latter during the periods of washing and sanitation of the apparatus). Near the vessel bottom 38 a temperature sensing device 41 is arranged, capable of generating a signal which is applied to a registering and controlling equipment 42 through a capillary line 43 (indicated by a dashed line).

A gas, such as carbon dioxide, is introduced into the vessel 33 from the gas input 25 (connected to a suitable gas source) through a manually adjustable valve 44, an automatically controlled valve 45 and conduit 46, the valve 46 being controlled by the registering and controlling equipment 42 through a pneumatic line 47 (indicated by a dashed line). The registering and regulating equipment receives information, about the pressure of the gas, through a line 48 connected to the vessel input. The registering and controlling equipment 42 controls the pressure of the gas, at the same time registering this pressure and also the temperature of the product at the bottom of vessel 33.

Vessel 33 is also provided with an indicating and controlling arrangement capable of controlling the level of the product in the bottom of vessel 33, comprising a level indicating tube 49 connected at one end to the bottom of the vessel and at its other end to the input at the top of the vessel by means of a conduit 51. Within the level indicating tube 49, two level control electrodes 52 and 53 are arranged, their respectively different lengths controlling the maximum and minimum levels of the product within vessel 33.

There is also provided an automatic washing arrangement for the distributing tray 36. When it is desired to carry out a complete washing and sanitation of the distributing tray without it being necessary to open the vessel 33, this can be done by closing the supply of syrup at input 16 so that, while pumps 12 and 20 are operating and the water input 2 to the deaerating vessel 1 is open, through the entire equipment will run only water which finally is discharged to a suitable drain through output 40. It will be understood that during the washing operation the gas supply (25) will be closed by means of valve 26. To obtain a more thorough washing of distributing tray 36, a washing water valve 54 is provided which has its input connected through coupling 55 to the rate-of-flow controlling valve 22, its output being connected through conduit 56 to a check valve 57 which within the vessel 33 is connected to a manifold 58 distributing the water to at least one (and preferably two or more) rotating water jet 59 which scatters the water onto the distributing tray 36. The washing efficiency is truly remarkable when the distributing tray comprises a specially designed structure as that described, illustrated and claimed in Argentine patent application Ser. No. 265.361 filed Nov. 5, 1976, by the same applicant.

From the general description given above it will be apparent to the skilled in this art that the essence of the present invention resides in certain new improvements introduced in some critical parts of the equipment and that the scope of the invention covers not only these improvements but also any equipment, of the kind referred to, which embodies such improvements. The various improvements introduced in such an equipment will now be described in detail to emphasize the novel features which characterize the invention and which allow the remarkable increase of efficiency and automatization which may be obtained by the use of the equipment of the present invention.

In summary, the new features embodied in the equipment generally described above, are:

(a) The deaerating device 3 based on the Venturi principle, which allows a better deaeration of the water supplied to the equipment;

(b) The special design of the automatic rate-of-flow regulating valve 22;

(c) The precarbonating device 24, which allows a more intimate contact between the liquid and gas (such as carbon dioxide) by the subdivision of the later in very diminute bubbles and producing an intense turbulence at the output of the device which improves the mixing action to a very high degree;

(d) The special design of check valve 34 which, besides its check action, allows also the attainment of a particularly efficient homogenization of the liquid-gas mixture;

(e) The device 35, based on the Venturi principle, which allows the attainment of a complete final saturation of the mixture with the gas (such as carbon dioxide) introduced into the final carbonating vessel through conduit 46;

(f) The special design of the distributing tray 36; during normal operation of the apparatus, the tray has a plurality of apertures of normal size, but the area thereof may be enlarged considerably during the washing and sanitation periods of the apparatus, so as to offer an easy passage to any fruit pulp residues and the like which are easily carried away by the washing liquid; and (g) The rotary washing liquid jets which allow a thorough washing of the distributing tray.

Having thus stated the novel features of the present invention, it must be emphasized once more that the most important of said features and the one that is principally responsible of the outstanding advantages obtained by the use of the apparatus of this invention, is the precarbonating device 24 which has been stated above under item (c). This novel feature of the apparatus is the truly decisive characteristic of the invention; stated in another way, an apparatus incorporating only this device without comprising any of the other improvements listed under items (a) and/or (b) and/or (d) to (g), would be enough to represent by itself the invention, while the incorporation of the other items (a) and/or (b) and/or (d) to (g) may be very convenient but not really essential. On the other hand, an apparatus comprising only one or more of these later items, but which does not incorporate item (c), would not provide the true and fundamental advantages offered by the invention. Every one of said additional items acquire importance only when incorporated to the apparatus together with item (c). Thus, to obtain the full advantages of the present invention, it is considered as an essential condition that it incorporates at least a precarbonating device 24 constructed in accordance with this invention.

However, to maintain a logic order in the following description, the several items (a) to (g) will be described in detail in the alphabetical order listed above; that is to say following the circulating path (through the apparatus) of the component elements of the final product, viz., the diluent component (such as water or the like), the syrup or like component, and the gas (such as carbon dioxide).

Referring now specifically to item (a) (the device 3 based on the Venturi principle), which allows a better deaerating of the water introduced into the apparatus and which is illustrated in detail in FIG. 2, it can be seen that it comprises a body indicated in general at 59, made of any suitable material (iron sheet, plastic material and the like), said body comprising two truncated conical shaped portions oppositely directed 60 and 61 the ends of lesser diameter thereof being connected together by a cylindrical central portion 62. Near the end of greater diameter of the truncated conical shaped portion 60, a plurality of circumferentially arranged orifices 63 are provided communicating the interior space of the top 64 of the deaerating tank 1 (see FIG. 1) with the interior space of the body 59 of the device. Within the interior space of the upper truncated conical shaped portion 60 is axially arranged a water input conduit 65, its upper end 66 being connected to the water input 2 through the water flow controlling valve 9 while its lower end 67 opens at a height about intermediate between the circumferential row of orifices 63 and the geometrical transversal plane passing through the connection between the upper truncated conical shaped portion 60 of the body and the cylindrical central portion 62 thereof. The interior space of said cylindrical central portion 62 of the body contains a diffusing assembly 68 which comprises a plurality of fins each arranged in the longitudinal direction of the device. When the stream of water issues from the lower end 67 of conduit 65, the lower pressure prevailing within the interior space of the cylindrical central portion 62 opens the stream in a circular fan shower, the division of the main stream into many small individual streams being still more improved by the fins of the diffusing assembly 68 thus allowing a much more effective deaeration of the water.

The deaerated water is withdrawn from the bottom of tank 1 by the pump 12 (see FIG 1) through conduit 11. To the output of pump 12 is connected a priming line 12'. From the output of pump 12 the deaerated water reaches the mixing-metering apparatus 15 (which by itself does not form part of the present invention and which has been described in the above mentioned U.S. Pat. No. 3,993,219) through conduit 13 and a check valve 69. It will be understood that to obtain the full advantages arising from the use of the present invention it is not essential (but it may be convenient) to use a mixing-metering unit like the one indicated in 15 on FIG. 1. Thus it will be possible to use any other equivalent apparatus capable of producing the desired results such as a good mixing action and an accurate metering of the two components, syrup and water. The syrup-water mixture is withdrawn from the mixing-metering apparatus 15 by means of a suitable pump 20 the output of which is connected to the rate-of-flow controlling valve 22.

The rate-of-flow controlling automatic valve 22 is of novel design and thus is another novel feature of this invention, as mentioned above under item (b). It will be now described in detail with reference to FIG. 3. The valve has been indicated in general at 22 and comprises a main body defining in general a cross-shaped internal cavity. This cavity has a mixture input 71 connectable to the output of the mixture pump 20 (see FIG. 1) by means of conduit 21, a mixture output 72 connectable to the precarbonating device 24 through conduit 23, an output 73 connectable to the washing liquid valve 54 and a control chamber 74. A piston and valve head assembly 75 is provided, comprising a piston indicated in general at 76 slidably arranged within the control chamber 74 and provided with a seal ring 77. This piston 76 is provided with a small calibrated through orifice 78 communicating the central cavity with the control chamber 74. Piston 76 is connected by means of a piston rod 79 to a conically shaped valve head 80 exteriorly provided with straight guiding portions 80' which engage the inner wall of output 72 and these guiding portions 80' defining between them the passages 80'' which have a cross-section increasing in the direction towards the output 72. The base of the valve head 80 has a greater diameter than the inside diameter of the output 72; thus, when the base 81 is seated against the edge of the inner opening of output 72, thus cutting-off any communication between the input 71 and said output 72. Valve head 80 has coaxial through passage communicating, through a restricted passage 83, with a second coaxial through passage 84 provided within the piston rod 79 and which opens to the control chamber 74 at the corresponding face of piston 76. A cylinder 85 is provided as an extension of control chamber 74. Within this cylinder 85 is slidably mounted a second piston indicated in general at 86 which is provided with a seal ring 87. A calibrated through orifice 88 is provided in piston 86 communicating the inner space of the cylinder 85 with the control chamber 74. One end of a piston rod 89 is connected to the piston 86 while its other end extends through the control chamber 74 and through the axial passage 84 of the piston rod 79 of the piston 76. The diameter of the piston rod 89 is slightly greater than the inside diameter of the restricted passage 83 and its end 90 has a conical shape so that when it is seated against the shoulder 91 defined between conduit 84 and passage 83 it shuts-off hermetically said passage 83. Within cylinder 85 an expansion spring 92 is arranged, one of its ends abutting against the cylinder bottom 93 and its other end abutting against the corresponding face of piston 86. The bottom 93 of cylinder 85 is provided with a passage 94 which is connectable, by means of a suitable coupling 95, to conduit 96 (see also FIG. 1) communicating with the mechanism (see U.S. Pat. No. 3,993,219) controlled by the float arrangement 97 of the syrup-water mixture tank 19 of the mixing-metering apparatus 15.

This valve 22 controls the rate-of-flow of the stream issuing from the output 72 according to the level of the liquid within the syrup-water mixture tank 19. Stated in general terms, the float 97 actuates closing conduit 96 when the level of the liquid lowers within tank 19; in other words when float 97 drops. When the liquid level rises the float also rises and opens conduit 96. Through conduit 21, the liquid is pumped under pressure to input 71 of valve 22. It will be assumed that at first the level of the liquid in tank 19 is lower than normal and thus float 97 will be in a low position, closing conduit 96. The liquid, subjected to the pressure created by pump 20, passes through the orifice 78 of piston 76 thus filling chamber 74 and thence through the orifice 88 of piston 86, thus filling also the cylinder 85. Conduit 96 will also be filled with the liquid, but it can not escape at the other end of said conduit which the float 97 maintains closed. Thus within the cylinder 85, the chamber 74 and the main space surrounding the piston rod 79, there will be the same pressure. Considering that the pressures acting on both faces of piston 86 are equal, the pressure of the spring 92 acting against the piston 86 will prevail, pushing the piston and its piston rod 89, the conical free end of the piston rod closing the coaxial passage 84. When passage 84 closes, the pressure will rise within chamber 74 pushing piston 76 in the direction in which the base 81 of valve head 80 will be firmly held against the corresponding internal edge of output 72. During the time that the valve head 80 maintains closed the output 72, the level of the liquid within tank 19 will rise, the float rising also and, after a certain point has been reached, the float arrangement opens the corresponding end of conduit 96 thus lowering the pressure in cylinder 85. The pressure acting on the face of the piston 86 facing the inner space of the cylinder, will now be lesser than the pressure acting on the opposite face thereof, thus producing the displacement of piston 89 within cylinder 85 towards its bottom 93 against the force of spring 92. Piston rod 89 moves away from shoulder 91 thus opening the conduit 82, restricted passage 83 and conduit 82, lowering the pressure in chamber 74. The pressure of the liquid entering through input 71 applies a pressure, against the face of piston 76 facing the general cavity of the valve, that is greater than the diminished pressure acting on the face of the piston facing chamber 74. Thus piston 76 will move towards piston 86 and valve head 80 will move away from the internal edge of output 72, allowing the liquid to pass directly from the input 71 to the output 72. If float 97 lowers, and thus closes again conduit 96, the pressure within cylinder 85 rises, this process ending when the pressures acting on both faces of the piston 86 become equal. Under this later condition the force of spring 92 will prevail pushing the assembly of piston 86 and piston rod 89, the free end of the piston rod closing the coaxial passage 84. The entire process will repeat itself according to the changes of level of the liquid within tank 19. Thus this valve arrangement allows to maintain a constant level of the syrup-water mixture within tank 19.

The washing liquid output 73 of valve 22 provides a direct path between the input 71 and said output 73 and allows the feeding of water or other suitable washing liquid from pump 20 to valve 54 during the periods of washing of the equipment. Valve 54 will remain closed during the entire periods of normal operation of the equipment and will be opened only during the periods at which it is desired to subject the entire equipment to a general rinsing or washing operation.

In FIG. 4 the construction of the precarbonating device is shown and is indicated in general by the reference numeral 24. The body 97 of the device comprises an input conduit 98 the input end 99 of which is connected to conduit 23 (FIG. 1). The input conduit 98 leads to a passage 101 the geometrical axis of which is directed at 90° to the geometrical axis of input conduit 98. Conduit 101 is internally shaped like a Venturi comprising an input portion 102 and an output portion 103, both having a substantially truncated conical shape, and being connected together at their minor bases. The zone of lesser diameter of portion 103 is surrounded by an annular chamber 104 of aproximately toroidal shape, and a substantially continuous thin annular slot 105 is provided substantially at the transverse section of lesser diameter of passage 101 communicating chamber 104 with the interior space of said passage 101. A gas input 106 is at one of its ends in direct communication with the annular chamber 104 while its other end is connectable to gas conduit 31 (see FIG. 1) which is connected to a suitable gas source 25, such as a source of carbon dioxide (not illustrated). The output end of the output portion 103 is connectable to conduit 32 (see FIG. 1) connected to the final carbonating vessel 33. Within passage 101 is axially arranged a control head 107, being in general drop-shaped and the base of which is aproximately hemispheric, having a substantially conical portion 109 which ends in a slightly rounded nose 110. The region which may be considered adjacent to the base of the cone 109 and which is located within the truncated conical input portion 102 of the Venturi, has an external shape and size substantially corresponding to the internal shape and size of the Venturi; however, internal surface of portion 102 is slightly more slanted, with respect to the longitudinal axis of the Venturi passage, than the external surface of portion 109, so that when the head 107 is only partially introduced within portion 102 there remains between them an annular passage 111 which becomes progressively more narrow as it comes nearer the annular slot 105. Thus, as head 107 becomes progressively more completely introduced within passage 111, the external surface of portion 109 finally abuts against the internal surface of the Venturi passage, closing off the central chamber 100 from the output 112 at the region where slot 105 is provided. Head 107 is connected to a coupling rod 113. The side of the central chamber 100, opposite to the side facing the Venturi passage, extends into a hollow cylindrical extension 114 within which extends the end 115 of coupling rod 113 opposite the end which carries control head 107. The extreme end of connecting rod 113 extends towards the outside of the cylindrical extension 114 and thereto is fixed a sleeve 116 having a skirt portion 117 and a cap 118, this latter being fixed to the extreme end of the connecting rod 113 by means of pin diametrically introduced therethrough. On the outer surface of the cylindrical extension 114 a graduated longitudinal scale (not shown) is engraved, as is common in the case of micrometer calipers. The longitudinal displacement of the free edge 120 of skirt 117 allows the reading of the longitudinal position of control head 107 on the external graduated scale. The external surface of portion 115 of connecting rod 113 and the internal surface of the cylindrical extension 114 are respectively provided with complementary micrometric threads 121 and 122. Connecting rod 113 is provided with a seal ring 123 of a suitable material such as neoprene or the like and the external surface of the cylindrical extension 114 is provided, near its open end, with another seal ring 124 which can also be of neoprene or the like. The assembly comprising the cylindrical extension 114, connecting rod 113 and control head 107, is axially aligned within the Venturi passage 102–103 with great accuracy. Assuming that the device 24 is being fed with the syrup-water mixture supplied by pump 20 through conduit 21, rate-of-flow control valve 22 and conduit 23, the liquid mixture will enter into the central chamber 100 through input 99 and therefrom will flow into passage 111 of decreasing diameter (in the direction of flow), passing in front of annular slot 105 and entering the truncated conical shaped output portion 103.

Assuming that the control head 107 is approximately in the position shown in FIG. 4 and that a gas, such as carbon dioxide, is supplied to the gas input 106 under pressure and at a certain flow rate previously adjusted by means of valve 26 and restriction 29, the velocity of the liquid flowing through annular passage 111 will produce a corresponding degree of suction (according to the Venturi principle) at annular slot 105. This suction, added to the pressure of the gas, will induce a corresponding rate-of-flow of the gas emerging from said slot 105 into passage 111, the gas mixing with the liquid flowing through said passage. Thus, the liquid flowing through passage 111 will collide violently with the gas emerging from slot 105, producing an intimate mixing action between gas and liquid, the gas being in the form of very tiny bubbles homogenously dispersed within the liquid. The mixing action is considerably improved by the fact that the liquid-gas mixture emerging from the annular passage 111 undergoes a sudden expansion when it flows into chamber 103' which has a progressively increasing diameter (in the direction of flow of the mixture), the space of said chamber 125 being that formed between the internal surface of the truncated conical shaped portion 103 and the external surface of the conical portion 109 of the control head 107. When cap 118 of the micrometer screw member is manually rotated in the corresponding direction, control head 107 will be progressively withdrawn from the Venturi passage so as to increase its cross-sectional area; this will produce a corresponding decrease of the velocity of the stream of liquid within the Venturi passage. Manually adjusting the restriction 29 according to the indication furnished by the "rotameter" (rate-of-flow meter) 28 and also manually adjusting the micrometer screw so as to increase (or decrease) the cross-section area of passage 111, it will be possible to obtain a certain combination of conditions suitable for the various different end products which must be manufactured. With the aid of tables, stating values corresponding to the required adjustment positions of restriction 29 and micrometric screw 118 for every set of conditions corresponding to each type of end product which must be manufactured, it will be possible to reproduce faithfully at any moment any desired of said set of conditions and thus produce the desired end product which has accurately the desired liquid mixture-gas ratio.

The precarbonating device 24 is the essential improvement according to this invention, since it improves in a very high degree the homogeneity of the desired end product and allows an accurate reproduction of the conditions which must be maintained to obtain an homogeneous product of constant characteristics. Thus, it must be understood that an apparatus embodying the precarbonating device according to the present invention represents by itself the essential invention and that the other improvements here described are convenient but not essential to obtain the benefits of this invention.

Check valve 34, provided at the syrup-water-gas mixture input to the final carbonating vessel 33, will now be described with reference to FIG. 5. It will be understood that the use of a check valve at this point of the apparatus is not new; moreover it is an obvious resource to avoid the possibility of backflow of gas from the entrance point of vessel 33 (at the corresponding end of conduit 32) back to the precarbonating device 24. However it must be noted that the novelty does not reside in the simple use of a check valve at this point of the apparatus, but in the particular and novel construction of the valve itself and in that, as a consequence of this particular construction, it performs not only the function of a check valve but simultaneously performs also the function of intentionally creating a turbulence which improves still further the mixing of the gas with the liquid (syrup-water).

Figure 5:
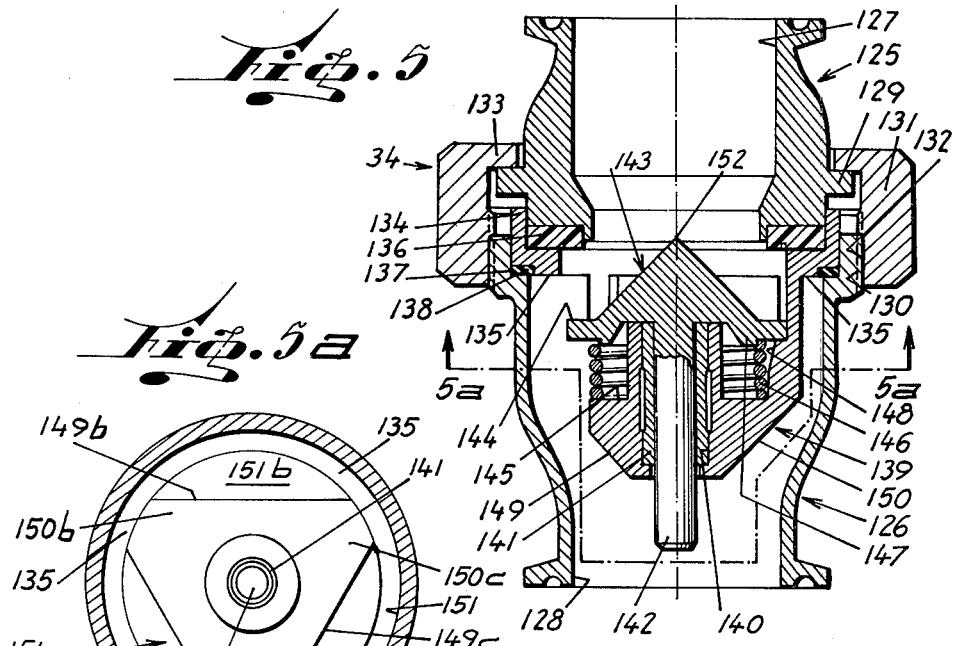
FIG. 5 is an elevation cross-section of the specially designed check valve used at the inlet to the final carbonating vessel.

It may be seen in FIG. 5, that valve 34 comprises a body which is formed by a first portion 125 and a second portion 126. First portion 125 offers an entrance 127 connectable to conduit 32 (see FIG. 1) connected at its other end to the precarbonating device 24, while the second portion 126 offers an output 128 connectable to the input at the dome of vessel 33. Near the end of the first portion 125, opposite the entrance 127, a flange 129 is externally provided while the corresponding end of the second portion 126 is externally provided with a screw-thread 130. The first and second portions 125 and 126 are assembled together by means of a connecting ring 131 which, at one of its ends, is provided with an internal screw-thread 132 complementary with screw-thread 130. Ring 131 has at its other end an inwardly directed annular edge 133. To assemble together both portions 125 and 126, ring 131 is made to slide over the end of first portion 125 corresponding to entrance 127 until the thread 132 engages thread 130. Ring 131 is then screwed onto the second portion 126 until its edge 133 engages the flange 129. After tightening firmly the ring 131, the first and second portions 125 and 126 will become sealingly assembled together with the interposition of other members which will be described below. Between the internal face of the inner end of the second portion 126 and the external face of the inner end of first portion 125 an axially and upwardly directed flange 134 of an annular base portion 135 is provided. This annular portion 135 sealingly engages the radial surface of the corresponding end of first body portion 125 with the interposition of a first gasket 136 which may be of ethyl propylene or the like and also sealingly engages an internal shoulder 137 of the second body portion 126 with the interposition of a second gasket 138 of the same or other suitable material. From the annular base portion 135 extends integrally downwardly a support member indicated in general at 139, which has a cross-section (along a plane normal to the geometrical axis of the valve) of a particular shape which will be described later on. Said support member 139 has an axial passage 140 internally lined with a sleeve 141 which is of a material of very low friction coefficient (such as polytetrafluoroethylene) within which is slidably arranged a guiding rod 142 the upper end of which supports an integral conically shaped valve head indicated in general at 143. The base of the cone 143 extends radially forming an annular flange 144 capable of seating on the gasket 136 in the closed position of the valve, so as to sealingly close any communication between the internal cavity of the first portion 125 and the internal cavity of the second portion 126. Between the shoulder formed on the support member 139 and the lower face of annular flange 144 a helical spring 146 is provided which remains centered by a circular flange 147 extending from the lower face of said annular flange 144 and the inner face 148 of the support member 139. Spring 146 normally biases the valve head 143 against the gasket 136 (the valve is shown on FIG. 5 in its open position, spring 146 being compressed).

Figure 5A:
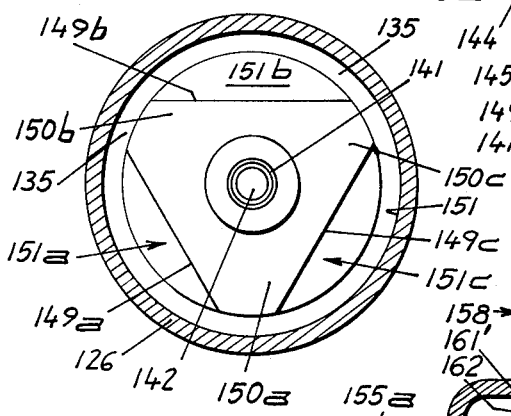
FIG. 5*a* is a bottom plan view looking into the valve of FIG. 5 from its output end to the input end.

The particular cross-section shape of the support member 139 may be better understood with reference to FIG. 5*a*, which is a bottom plan view looking axially from the output 128 towards the interior of the valve. As can be seen, the support member 139 has in general the shape of a triangular pyramid the base of which is an equilateral triangle which has each of its vertices truncated along a line normal to the bisector of the corresponding angle. In FIG. 5*a* the sides of the triangle are indicated at 149*a*, 149*b* and 149*c*, and the corresponding lines along which the vertices are truncated are indicated at 150*a*, 150*b* and 150*c*. Thus between the internal face 151 of the second portion 126 and the sides 149 there are provided corresponding passages 151*a*, 151*b* and 151*c*. The mixture of liquid and gas coming from the precarbonating device 24 through conduit 32, enters the valve 34 through entrance 127 and makes contact with the apex 152 of the valve head 143. Assuming that the pressure of the liquid-gas mixture, arriving through conduit 32, is higher than the pressure of the gas, such as carbon dioxide, prevailing within the final carbonating vessel 33, valve head 143 will be pushed against the force of spring 146 so as to open the passages 151 through which the mixture will go to the output 128 and thence to the vessel 33. The particular construction of this valve produces a division of the stream of liquid and gas, through passages 151, into three smaller streams the velocity of which increases when passing through said passages, and thereafter the three streams meet again at the zone of the output 128 colliding in such a manner as to give rise to a turbulence action which greatly improves the mixing of the liquid with the gas. The increased velocity of the partial streams at their pass through the passages 151 of lesser cross-section area than the entrance and the output ends of the valve, makes more violent the collision between them and improves considerably the mixing action.

As already mentioned above, the input of the mixture to the vessel 33 takes place through a device based on the Venturi principle, indicated in general at 35 on FIG. 1. This device is of a construction entirely similar to the construction of the Venturi device 3 provided at the input to the deaerating vessel 1 and illustrated in detail in FIG. 2. Referring again to this later figure, but now in connection with the Venturi device 35, the upper end 66 of conduit 65 is connected to the output 128 of check valve 34 (see FIG. 5), thus receiving the mixture of syrup, water and gas coming from the precarbonating device 24. From the output 67 of conduit 65, the cross-section of the mixture is enlarged according to a circular fan-like pattern and creates a suction effect at the orifices 63 and thus the gas, such as carbon monoxide, injected into vessel 33 by the source 25 through conduit 46, will be sucked from vessel 33 through said orifices towards the interior space of the upper truncated conical portion 60 of device 35 and will be carried downwardly intimately mixing with the mixture coming from the output 67 of conduit 65, and becomes finally saturated with the gas. This action is still more improved by the diffusing assembly 68 and by the expansion to which it is subjected within the lower truncated conical portion 61. The mixture, after having been saturated with the gas, falls onto the distributing tray 36 and drips along the cooling plates 37 finally collecting onto the bottom of vessel 33.

It must be noted that while along the entire course of the syrup-water-gas mixture it is desirable to produce turbulences which progressively improve the diffusion of the gas within the liquid, from the vessel bottom 38 to the final filling equipment (not illustrated) it is desirable that the end product will be subjected to a minimum of turbulence and agitation to avoid that the liquid, now saturated with the gas, may again give away this gas. Thus any sudden change of direction, turbulences, etc., of the end product within conduit 39 and at the output 40 must be avoided as much as possible.

The special construction of the distributing tray 36 will now be described with reference to FIGS. 8 to 18. This specially designed distributing tray allows an exhaustive washing and sanitation of the tray. The basic principle of the design is that the cross-section of the apertures provided in a tray of conventional design may be easily enlarged during the washing periods by means manually or automatically controllable from the exterior of vessel 33 without the necessity of opening the vessel 33 or reaching within it. Once the washing period is over, the size of the apertures may be again restored to their original dimensions.

In conventional constructions of the final carbonating vessel there is generally provided a distributing tray capable of distributing the liquid-gas mixture from the entrance to the cooling plates as a shower of a plurality of very thin streams of liquid. To this end, the distributing tray is provided with a plurality of apertures of comparatively small area uniformly spaced apart over the area of the tray. Such apertures, which in general are comparatively small, become easily obstructed by residues carried by the liquid-gas stream, particularly residues of fruit pulp when a syrup based on fruit juice is used.

The special design of the distributing tray of the present invention is based on the principle of enlarging or increasing the effective cross-sectional flow area of the apertures only during the washing, cleaning and sanitation periods, while during normal operation of the equipment the apertures will maintain their normal area.

By the term "aperture" must be understood an aperture of any shape, such as round, square, rectangular, etc. No limitation of shape nor size must be assigned to this term. The increase of effective cross-sectional flow area of the apertures may be obtained in many different ways. However, it can be stated in general terms that it may be obtained by means of a relative movement between two members one of which has said apertures and the other being capable of restricting their area during the periods of normal operation but which increases said cross-sectional area during the washing periods by a movement of mechanical displacement. The mechanical displacement may be an up and down movement, a rotary movement or any other movement capable of producing the desired result of enlargement of said effective cross-sectional flow area of the apertures. Many different embodiments may be designed, all of which are capable of providing this desired result. Some of these embodiments will be now described with reference to FIGS. 8 to 18.

Figures 8, 9:
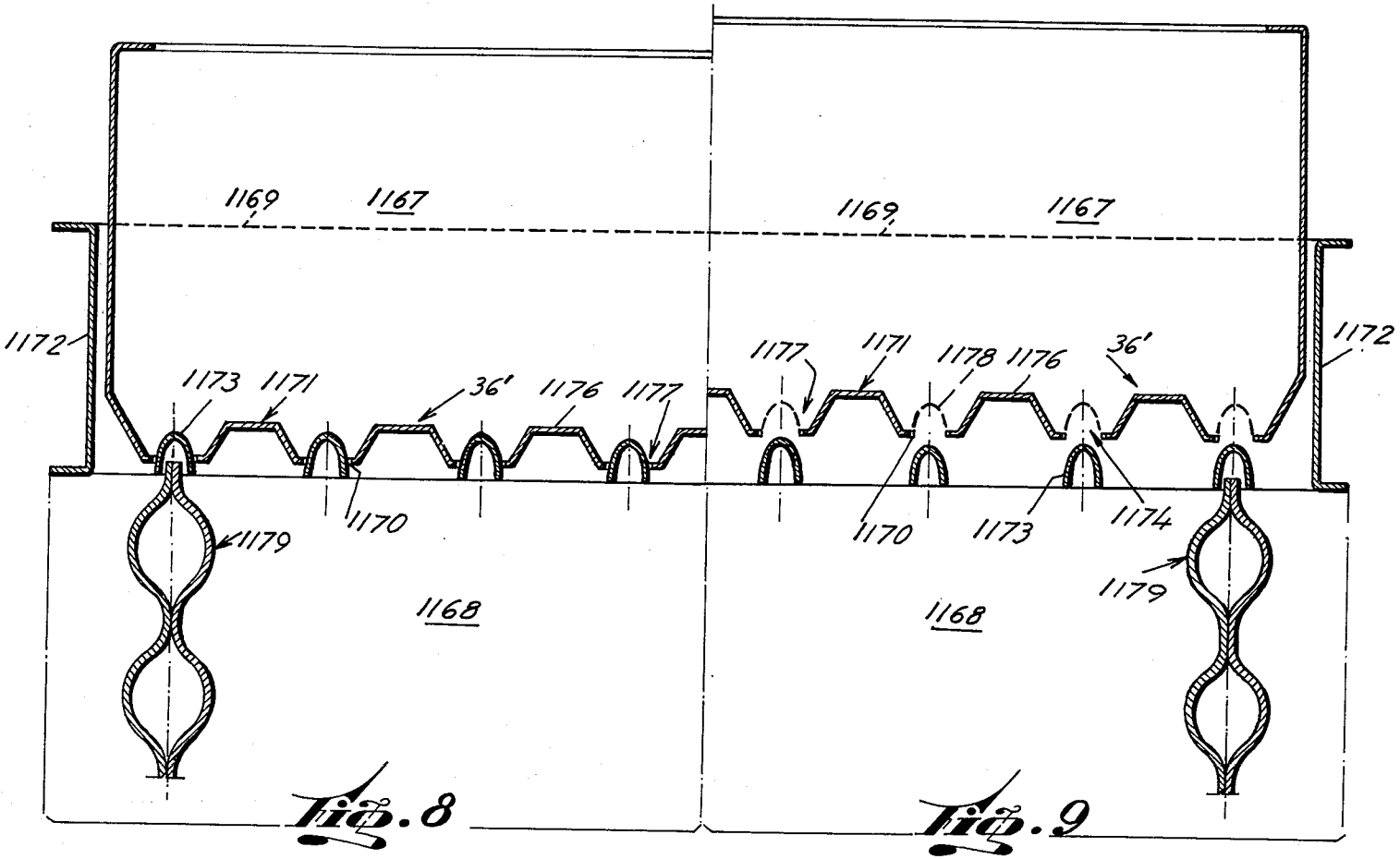

In FIGS. 8, 9 and 10, it can be seen that tray 36' comprises a partition wall provided with a plurality of apertures (as defined above) and which separates the upper compartment 1167 from the lower compartment 1168. Thus the liquid 1169 contained within the upper compartment 1167 must go necessarily through the apertures 1170 provided in the partition wall or bottom 1171. In this embodiment, the entire assembly of the tray 36' is movably mounted with respect to a surrounding support 1172 to which are fixed the ends of a plurality of ridges 1173 having a half-rounded shape slightly flattened. These ridges fit into elongated windows 1174 provided at the bottom 1171; one of the outstanding features of these elongated windows 1174 is that on each of their longitudinal edges there are provided a plurality of indentations 1175. Thus between the ridges 1173 and the indentations 1175 of the elongated windows 1174 said apertures 1170 are defined as will be explained later on. Bottom 1171 forms prismatic ribs 1176 between which channels 1177 are formed which, in the position of the tray corresponding to normal operation of the equipment, are located at each side of the corresponding ridge 1173. To allow the rightly fitting of the tray 36' astride onto the ridges 1173, the tray is provided on its opposed sides with notches 1178 which have the same half-rounded slightly flattened shape as that of the ridges 1173; that is to say an ogival shape.

The operation of this embodiment will have been easily understood from what has been described and illustrated above. Assuming that the ridges 1173 are fitted within the elongated windows 1174, the series of open indentations 1175 will now be closed, thus defining the plurality of aligned apertures 1170 allowing the flow of liquid 1169 as a fine shower falling onto the cooling plates 1179 provided within the lower compartment 1168. After a certain time of operation these apertures 1170 will become clogged up with the residues, such as fruit pulp and other impurities carried by the liquid impeding the free flow thereof and contaminating it, since some of said residues may become toxic after a rather long time has elapsed. In such a situation it will be enough to displace upwardly the tray 36' (see FIG. 2) to open the relatively small apertures 1170 which normally are perimetrically closed, and which now will be converted to the open indentations 1175; thus the said apertures of small diameter 1170 will be converted to the comparatively large elongated window 1174. In such a condition, high pressure jets directed onto tray 36' will easily sweep or carry away the solid impurities which may have clogged up wholly or partially the apertures 1170. Once the washing operation has been performed, tray 36' will be again restored to its original position, now closing the open indentations and thus leaving only the small apertures 1170, allowing the normal operation of the equipment. The skilled in this art will easily understand that it is immaterial to move up and down tray 36' respect to support 1172, or to move up and down the support 1172 respect to tray 36'. The simultaneous relative movement of both elements 36' and 1172 (of course each in the opposite direction of the other) may obviously serve the same purpose.

In the embodiment illustrated in FIGS. 11 and 12, the same principle of operation has been applied; however, the bottom 1171' of tray 36', instead of comprising the ribs 1176, has a plurality of conduits 1180 each provided with a series of orifices like the one indicated at 1181 along both of its lower edges 1182. In this embodiment each fixed ridge 1173' fixed to the surrounding support 1172', is provided at each side thereof with a flange directed at about 90° with respect to the vertical direction of the ridge and indicated by the reference numeral 1183. The flange has a series of indentations 1175' cooperating with one of the plane faces of the corresponding conduit 1180 defining the apertures 1170' which allow the flow of the liquid contained in the upper compartment 1167'.

In this embodiment, conduits 1180 channelize the washing liquid which, through orifices 1181, will emerge therefrom as thin jets, when the tray 36' is in its washing position illustrated in FIG. 12, falling onto the indentations 1175' of flanges 1183 of the ridges 1173', thus sweeping away the residues which may be obstructing the flow of the liquid. When tray 36' is in its normal operating position illustrated in FIG. 11, it defines apertures 1170' which are similar to the apertures 1170 of the embodiment described above.

Figures 13, 14, 15, 16, 17, 18:
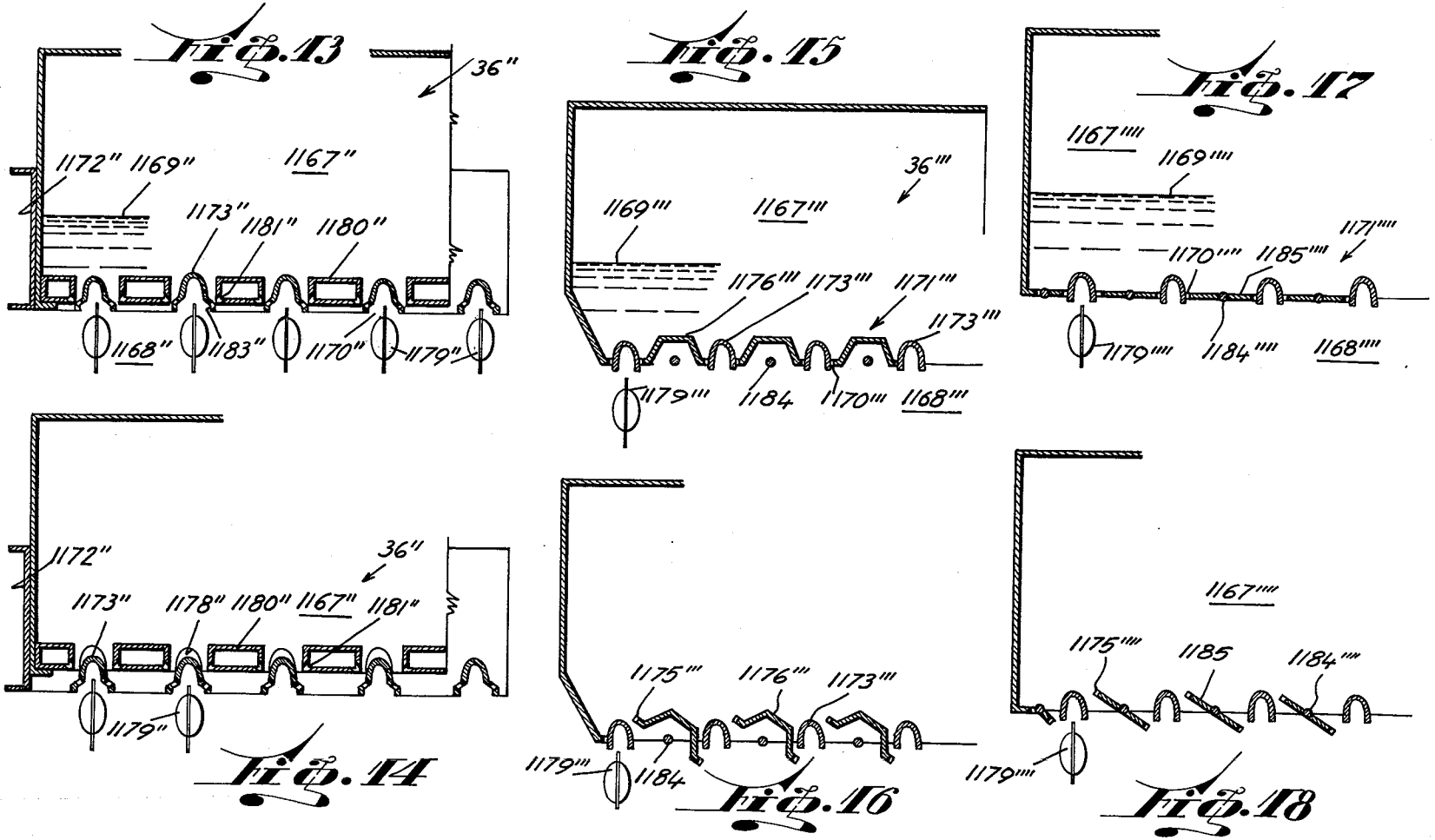

A very similar embodiment is illustrated in FIGS. 13 and 14. As can be seen, the only difference from the preceding embodiment is the fact that the apertures 1170" are provided on the flanges 1183" of the ridges 1173". In this embodiment the indentations 1175' are not necessary. Thus the jets of washing water emerging from the orifices 1181" of conduits 1180" will be directed against said apertures 1170" clearing them from residues and restoring the operation of the tray 36' to its clean condition.

Another embodiment of tray 36 is shown in FIGS. 15 and 16, this embodiment being also comprised within the general basic principle of the invention. The bottom 1171''' has a conformation which is similar to that of the bottom 1171 of FIGS. 8 and 9, but in the embodiment presently under consideration each prismatic rib 1176''' comprises an individual member capable of rotating by means of an associated shaft 1184, thus forming an articulated bottom capable of changing the shape and size of the circular apertures 1170''' to simple indentations 1175''' from which it is easy to dislodge any residues adhered thereto by means of water jets suitably directed.

The embodiment illustrated in FIGS. 17 and 18 has been designed along somewhat similar lines. In said figures it can be seen that the only difference with the embodiment of FIGS. 15 and 16 is that the bottom 1171'''' is not provided with the ribs 1176''', having instead a series of individual plates 1185, each plate being associated with a corresponding shaft 1184'''' by means of which it may be rotated. In a manner similar to that described with reference to the preceding embodiment, in this case each longitudinally rotatable plate is also provided, at its longitudinal edges, with a series of indentations 1175'''' which, when the plate is in the position shown in FIG. 17, define apertures 1170'''' allowing the liquid 1169'''', contained in the upper compartment 1167'''', to flow therethrough. When the plate 20 is rotated by means of its shaft 1184'''' to the position illustrated in FIG. 18, it will substitute the apertures 1170'''' by elongated passages which, also by means of jets of washing water, will make it easy to dislodge and carry away to a drain the residues which may have been clogging the said former apertures.

The skilled in the art will have appreciated that the principle, on which is based all of the embodiments of the distributing tray which have been described and illustrated, is in all cases the same, and that the novel conception resides in the means for allowing a fast and easy cleaning of the distributing tray within the final carbonating vessel 33, without the necessity of dissassembling, not even partially, the vessel 33. The control means external to vessel 33, for producing the relative displacement of the movable element or elements of the distributing tray assembly have not been described above, since they form no part by themselves of the present invention, and may be entirely conventional. They may be of course electromagnetically, hydraulically or neumatically actuated or they may be even manually operable, from the outside of vessel 33.

The automatic rinsing and washing arrangement, allowing a thorough washing of the distributing tray 36, will now be described. This arrangement comprises manifold 58 and rotating jets 59 (see FIG. 1), and will presently be described in detail with reference to FIGS. 6 and 7. When valve 54 is opened, and syrup input 16 and solenoid valve 30 are closed, pumps 12 and 20 will produce the flow only of washing liquid through the apparatus and the liquid will pass through a conventional check valve 57 (opening only during the washing periods) entering into final carbonating vessel 33 and manifold 58. Manifold 58 will carry the washing liquid to one or more rotating jets 59 (preferably at least two) which will throw a plurality of water streams onto distributing tray 36, washing and cleaning it thoroughly. The entire surface of the tray will be sprinkled with water due to the rotation of jets 59. It is not considered necessary to describe here in detail the manifold 58 since it is simply a conduit dividing the entering stream of washing liquid into as many partial streams as jets 59 are provided.

Figure 6:
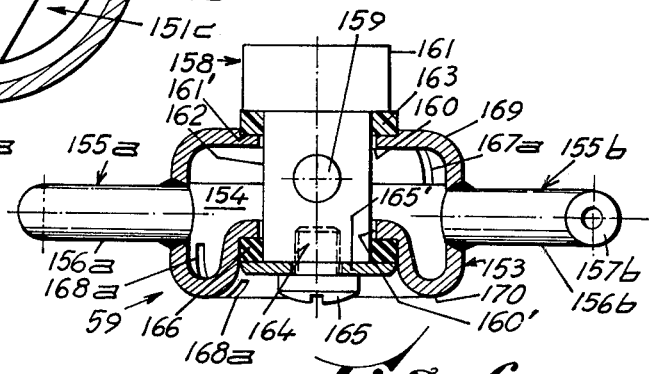
FIG. 6 is an elevation cross-section of a rotatable jet device for the automatic washing and sanitation of the distributing tray provided in the final carbonating vessel.
Figure 7:
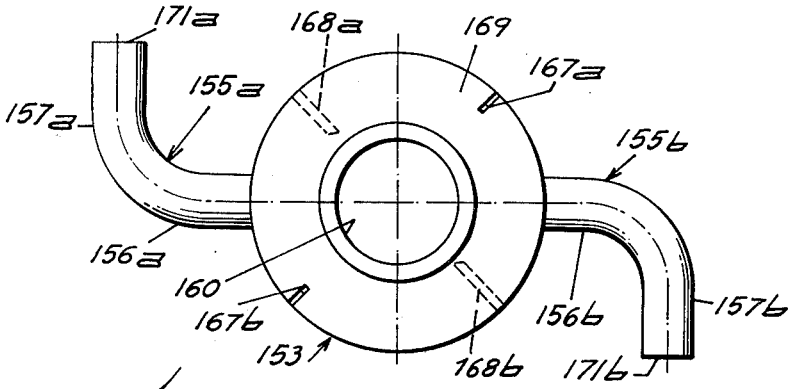
FIG. 7 is a top plan view of the rotatable jet device shown in FIG. 6.

Each rotating jet comprises a hollow body 153 which has a substantially toroidal shape and defining an internal cavity 154. From this body at least one arm (preferably two or more to obtain a better static and dynamic balance) projects radially. In FIG. 6 two arms **155*a* and 155*b* are shown, each comprising a first radial portion 156*a* and 156*b* respectively, and a second portion 157*a* and 157*b* respectively which are directed at 90° to the corresponding first portion. Body 153 is rotatively mounted on a supporting cylindrical sleeve 158 fixedly secured to manifold 58 (not shown in FIGS. 6 and 7). The hollow interior of sleeve 158 is in communication with cavity 154 through at least one radial aperture 159. Body 153 has axial through apertures 160 and 160'. Sleeve 158 has an upper portion 161 of substantially greater diameter than the axial apertures 160-160', and will be connected with manifold 158 in any suitable manner, and a lower portion 162 having an internal diameter slightly smaller than the diameter of apertures 160-160'. Between the external upper face of body 153 and the downwardly directed face of the annular shoulder 161' of sleeve 158 there is provided a gasket ring 163 made of a material having a very low friction coefficient (such as polytetrafluoroethylene). The closed lower end of sleeve 158 has a blind aperture 164 bored therein internally threaded in which a correspondingly threaded screw, having a head of slightly greater diameter than the threaded shank of the screw, may be introduced. Between the head of the screw 165 and the lower end of sleeve 158 there is provided a retaining washer 165'. Between the upper face of washer 165' and the inner edge of body 153, which defines aperture 160', there is provided a lower gasket ring 166 of substantially the same shape, dimensions and material as the upper gasket ring 163. Thus body 153 will be rotatively mounted on the lower portion 162 of sleeve 158, and the internal cavity 154 of the body will be sealed against leaks of liquid by the gasket rings 163 and 166**.

Furthermore body 153 is provided with four radial slots **167*a*, 167*b*, 168*a* and 168*b*, two of which 167*a* and 167*b*, which are arranged substantially on the same mean diametral vertical plane passing through the center of the body 153, extend from about the mean circunferential line of the body, defined by the horizontal plane of symmetry of the body, as far as about half the radial distance of the upper face 169 of the body, and the other pair of slots 168*a* and 168*b* are provided in the lower face 170 of the body and extend from about the height at which washer 165' is provided as far as said mean circunferential line. However it will be noted that slots 168*a* and 168*b* are arranged at opposite sides of a vertical plane passing through the center of body 153, slot 168*a* being provided slightly sidewards from one side of said plane and slot 168*b* being provided slightly sidewards from the opposite side of said plane. The reason for providing these slots is that the outlets 171*a* and 171*b* of the arms 155*a* and 155*b*, respectively, produce a sprinkling which does not cover the portion of the distributing tray 36 being directly below each rotating jet 59. Furthermore the water thrown by each outlet 171 falls only by gravity onto the distributing tray 36 in the form of a circular ring, while slots 168 will direct downwardly a rotating radial curtain of water which will cover substantially the entire upper surface of the distributing tray 36 and the water thrown by these slots will strike the tray with a force which is the result of gravity only, but also with the high pressure of the fluid supplied to each rotating jet 59. It may be considered that the water thrown by the outlets 171 is mainly used to rotatingly drive the water jets 59 while the slots 167 and 168 provide actually the water which performs the true cleaning action. The function of slots 167*a* and 167*b* is to throw washing liquid against the inner surface of the dome of vessel 33. It will be understood that while four slots have been described and illustrated, the use of only two slots (such as 167***a* and 168*a*) or more than four is possible within the scope of the invention, as well as the use of a number of slots 167 which is different from the number of slots 168.

Operation of these rotating jets is based on the well-known Barker's mill principle. The washing liquid tangentially gushed from the open ends of arms 155 produces a reaction effect which makes the jet to rotate fast. Thus the washing liquid will sprinkle the entire surface of distributing tray 36 rinsing, washing and cleaning it thoroughly. The cleaning action is very much improved when tray 36 is of the construction described and illustrated in FIGS. 8 to 18. However, while the use of such a distributing tray may be convenient, it is not essential to obtain the main benefits provided by the present invention. It is possible of course to use any other suitable construction of the distributing tray 36 which will allow the obtaining of similar or at least satisfactory results.

To perform a washing and cleaning operation it is necessary first to close the syrup input 16 and the supply of carbon dioxide by means of the solenoid valve 30. The micrometric screw of precarbonating device 24 (FIG. 1) is adjusted to its position of maximum opening of its Venturi passage and the end product output 40 is connected to a suitable drain. Without closing the supply of water at input 2 of the deaerating tank 1 and starting the pumps 12 and 20, only water will flow through the entire apparatus, washing and cleaning it, including distributing tray 36, and the washing water, together with residues which may be clinging to different parts of the equipment, will be discharged through output 40. This rinsing and washing operation may be necessary even if the apparatus is used only to produce always the same end product or it may be also necessary after having ended the production of a certain end product and before starting the production of another end product having different characteristics, thus avoiding the presence of foreign matter in the second end product.

The skilled in this art will easily understand that it will be possible to provide control means (manual or automatic) which will allow to disconnect the syrup input 16 from its corresponding source and connecting it to a pressurized source of a suitable washing and sanitation liquid so as to flow through all the parts of the apparatus with the exception of its parts through which, during normal manufacturing operations, flows only water (such as the deaerating vessel 1, pump 12 and tank 14, and associated conduits).

It must also be noted that while the apparatus of the present invention has been particularly described with reference to the manufacture of soft drinks or gaseous beverages, it is equally usable in any operation in which it is necessary or desirable to gasify (with carbon dioxide or any other suitable gas) a liquid one of the components of which is water or some other fluid from which air must be excluded as much as possible, it being necessary to maintain highly constant the ratio between the two main components of the end product and it being desirable to obtain the highest possible diffusion of the gas component into the liquid. This may prove desirable in certain applications, such as in the chemical industry, and such other uses must be considered as encompassed by the scope of this invention.

While I have described and illustrated some particular embodiments of the present invention, it will be understood that several changes and alterations may be introduced therein which however must be considered as encompassed by the spirit of the invention and its scope as defined in the following claims.

I claim:

1. An apparatus for manufacturing gasified liquids comprising a water deaerating vessel, a metering and mixing device connected to said water deaerating vessel and having a syrup-water mixture tank, a precarbonating device connected to said metering and mixing device, and a final carbonating vessel connected to said precarbonating device, said precarbonating device comprising: a Venturi chamber having an input section connected to an output of said syrup-water mixture tank and having an output section connected to an input of the final carbonating vessel; a flow control member arranged within said chamber and shaped so as to greatly promote turbulence in the flow of liquid through said chamber; and gas input means connectable to a source of pressurized gas and communicating with said chamber.

2. An apparatus according to claim 1, wherein the precarbonating device further comprises a body within which said Venturi chamber is formed, said flow control member being substantially tear-shaped and being axially displaceably arranged within said chamber with a nose portion projecting within said output section and a base portion thereof having a substantially greater diameter than that of the minimum diameter portion of the Venturi chamber, said gas input means comprising a substantially continuous circular channel provided within said body at the region of said minimum diameter portion of the Venturi chamber and communicating therewith and having an input connection which is connectable to said pressurized gas source.

3. An apparatus according to claim 1, wherein said final carbonating vessel includes at its input a check valve having an inlet connectable to said output section of the precarbonating device and having an outlet connectable to an inlet of the final carbonating vessel, said check valve having a body within which high turbulence creating means are arranged.

4. An apparatus according to claim 3, wherein said body of the check valve has a valve seat shoulder projecting radially from an internal wall of the body, a conical valve member arranged within said body so as to be axially displaceable therein and having a peripheral flange seatable against said seat valve shoulder in the closed condition of the valve, spring means normally urging said peripheral flange of the valve member towards said valve seat shoulder, and supporting and guiding means for said valve member having a pyramidal shape, the vertices of the polygonal base of the pyramid extending in the axial direction of the body substantially down to the valve seat shoulder and being there fixed to the inner wall of the body.

5. An apparatus according to claim 1, wherein said final carbonating vessel includes a liquid-gas mixing Venturi device arranged within said vessel and having an input defining the inlet to the vessel and being connectable to conduit means leading from said precarbonating device, the Venturi device being capable of providing a very intimate mixing action between the incoming liquid-gas mixture and a gaseous atmosphere prevailing within an internal dome portion of the vessel.

6. An apparatus according to claim 5, wherein said liquid-gas mixing Venturi device comprises an upper section and a lower section, both having a truncated conical shape, the smaller bases of which are united by a cylindrical central portion within which a diffusing assembly is mounted, said diffusing assembly comprising a plurality of fins each arranged in the longitudinal direction of the cylindrical central portion, the upper end of said upper section being mounted on the inner wall of the dome portion of the vessel and being closed thereby, a plurality of apertures being provided circumferentially around a wall of said upper section nearer to said upper end thereof than to its smaller end joined to said cylindrical central portion, and an axially arranged input conduit having an upper end defining said inlet to the vessel and a lower end opening and extending into said upper section and ending below said circumferentially provided apertures and comparatively near said cylindrical central portion.

7. An apparatus according to claim 1, wherein said syrup-water mixture tank of said metering and mixing device is connected with said precarbonating device by connecting means including a rate-of-flow controlling automatic valve capable of automatically controlling the rate-of-flow of the liquid mixture, supplied from said tank to said precarbonating device, in response to the liquid level within said tank, so as to automatically reduce the rate-of-flow in response to a decrease of said liquid level and vice-versa.

8. An apparatus according to claim 7, wherein the rate-of-flow controlling automatic valve comprises a body within which is formed a cross-shaped cavity comprising four orthogonally directed branches radiating from a central portion, a first of said branches being connectable to said syrup-water mixture tank, the oppositely directed second branch being connectable to a washing liquid conduit, a third of said branches extending into a cylinder the opposite end of which is connectable to a conduit connected to a control arrangement provided at said tank and operable in response to the liquid level therein, a piston slidably arranged within said cylinder, spring means normally urging said piston away from the bottom of said cylinder, the piston being provided with a calibrated through orifice, a pushing rod extending from the face of said piston opposite to the bottom of said cylinder, the free end of said pushing rod being sharp-pointed so as to form a needle valve and the pushing rod being aligned axially with said third branch, a valve assembly comprising a second piston member, a valve head member and a hollow intermediate portion connecting them, said second piston member having a second calibrated through orifice and being slidably arranged within said third branch, said hollow intermediate portion and valve head member having an axial passage comprising a first portion, a second portion of lesser diameter than said first portion, a shoulder being formed between them capable of acting as a valve seat for said pushing rod, and a third portion opening at the end of said valve head member, the nose portion of the valve head member extending within the fourth of said branches and its base portion having a slightly greater diameter than that of the end of said fourth branch facing the central portion of the body so that said valve head member is capable of closing the input of said fourth branch when its base portion is seated against said edge, and said fourth branch being connectable to the input of said precarbonating device.

9. An apparatus according to claim 1, wherein said water deaerating vessel includes a deaerating Venturi device arranged within said vessel and having an input defining the inlet to the vessel and being connectable to a source of water, the Venturi device being capable of providing a substantially complete deaerating action, so that the water gives off the maximum possible percentage of the air contained therein.

10. An apparatus according to claim 9, wherein said deaerating Venturi device comprises an upper section and a lower section, both having a truncated conical shape the smaller bases of which are united by a cylindrical central portion within which a diffusing assembly is mounted, said diffusing assembly comprising a plurality of fins each arranged in the longitudinal direction of the cylindrical central portion, an upper end of said upper section being mounted on an inner wall of a dome portion of the vessel and being closed thereby, a plurality of apertures being provided circumferentially around the wall of said upper section nearer to said upper end thereof than to its smaller end joined to said cylindrical central portion, and an axially arranged input conduit, the upper end of which defines said inlet to the vessel and the lower end opening and extending into said upper section and ending below said circumferentially provided apertures and comparatively near said cylindrical central portion.

11. An apparatus for manufacturing gasified liquids comprising a water deaerating vessel, a metering and mixing device connected to said water deaerating vessel and having syrup-water mixture tank, a precarbonating device connected to said metering and mixing device, and a final carbonating vessel connected to said precarbonating device, said precarbonating device comprising: a Venturi chamber having an input section connected to an output of said syrup-water mixture tank and having an output section connected to an input of said final carbonating vessel, a flow control member arranged within said chamber and shaped so as to greatly promote turbulence in the flow of liquid through said chamber, and gas input means connectable to a source of pressurized gas and communicating with said chamber, said final carbonating vessel having a check valve with an inlet connected to said output section of the precarbonating device, and an outlet connected to an inlet of the final carbonating vessel, said valve having a body within which high turbulence creating means are arranged, said final carbonating vessel also including a liquid-gas mixture Venturi device arranged within said vessel and having an input defining the inlet to the vessel and connected to conduit means leading from said precarbonating device, the Venturi device being capable of providing a very intimate mixing action between the incoming liquid-gas mixture and the gaseous atmosphere prevailing within an internal dome portion of the vessel, said syrup-water mixture tank being connected with said precarbonating device by means including a rate-of-flow controlling automatic valve capable of automatically controlling the rate-of-flow of the liquid mixture, supplied from said tank to said precarbonating device, in response to the liquid level within said tank, so as to automatically reduce the rate-of-flow in response to a decrease of said liquid level and vice versa, and said water deaerating vessel including a deaerating Venturi device arranged within said vessel and having an input defining the inlet to the vessel and being connectable to a source of water, the Venturi device being capable of providing a substantially complete deaerating action, so that the water gives off the maximum possible percentage of the air contained therein.

12. In an apparatus for manufacturing gasified liquids of the type having a water deaerating vessel, a metering and mixing device connected to said water deaerating vessel and having a syrup-water mixture tank, a precarbonating device connected to said syrup-water mixture tank, and a final carbonating vessel connected to said precarbonating device, the improvement wherein said precarbonating device comprises:

a Venturi chamber having an input section connected to an output of said syrup-water mixture tank and an output section connected to an input of the final carbonating vessel;

a flow control member arranged within said chamber and shaped so as to greatly promote turbulence in the flow of liquid through said chamber; and gas input means connectable to a source of pressurized gas for supplying pressurized gas to said chamber.

13. The improvement according to claim 12, wherein the precarbonating device further comprises a body within which said Venturi chamber is formed, said flow control member being substantially tear-shaped and being axially displaceably arranged within said chamber with a nose portion projecting within said output section and a base portion therof having a substantially greater diameter than that of a minimum diameter portion of the Venturi chamber, said gas input means comprising a substantially continuous circular channel provided within said body at the region of said minimum diameter portion of the Venturi chamber and communicating therewith and having an input connection which is connectable to said pressurized gas source.

14. The improvement according to claim 13, wherein said precarbonating device further comprises a coupling rod extending axially from said base portion of said flow control member, said coupling rod having a threaded end spaced from said base portion; and wherein said precarbonating device further includes a cylindrical member extending from said chamber and threadedly engaging said threaded end of said coupling rod so that rotation of said coupling rod axially displaces said flow control member.

15. A device for intimately contacting a liquid and a gas comprising:

a housing having an input conduit, an output conduit, and a Venturi-shaped conduit having an inlet connected to the input conduit and an outlet connected to the output conduit, said Venturi-shaped conduit having a zone of lesser diameter intermediate ends thereof;

a control member having a generally conical shaped end portion disposed within an input portion of said Venturi-shaped conduit so that an annular flow passage is formed between said control member and portions of said housing forming the input portion of said Venturi-shaped conduit, said control member and input portion being shaped in such manner that the annular flow passage decreases in size in a direction extending from said inlet towards said zone of lesser diameter;

means for axially translating said control member to thereby control the size of said annular flow passage;

said housing further having a thin annular slot communicating with and surrounding said zone of lesser diameter, said slot being connectable to a source of pressurized gas so that liquid flowing through said annular flow passage collides violently with gas emerging from said annular slot thereby producing an intimate mixing action between the liquid and gas.

16. A device according to claim 15, wherein said input conduit extends perpendicular to an axis of said Venturi-shaped conduit.

17. A device according to claim 15, wherein said means for axially translating includes means for rotating said control member so that translation of said control member is accurately controlled.

* * * * *